US009940912B1

(12) United States Patent
Brandenstein

(10) Patent No.: US 9,940,912 B1
(45) Date of Patent: Apr. 10, 2018

(54) DEVICE FOR PREVENTING A PLECTRUM FROM ENTERING INTO INSTRUMENTS

(71) Applicant: Michael J Brandenstein, St. Louis, MO (US)

(72) Inventor: Michael J Brandenstein, St. Louis, MO (US)

( * ) Notice: Subject to any disclaimer, the term of this patent is extended or adjusted under 35 U.S.C. 154(b) by 0 days.

(21) Appl. No.: 15/368,644

(22) Filed: Dec. 4, 2016

(51) Int. Cl.
*G10D 3/02* (2006.01)
*G10D 1/08* (2006.01)

(52) U.S. Cl.
CPC ..... *G10D 3/02* (2013.01); *G10D 1/08* (2013.01)

(58) Field of Classification Search
CPC ..... G10D 3/02
See application file for complete search history.

(56) References Cited

U.S. PATENT DOCUMENTS 4,394,830 A * 7/1983 Damiano ..... G10H 3/18 84/267
4,632,003 A * 12/1986 Kopp ..... G10D 1/085 84/267
D393,275 S * 4/1998 Andrenacci ..... D17/20
6,681,661 B2 * 1/2004 Lalonde ..... G10D 3/02 84/267
7,259,308 B2 * 8/2007 Geiger ..... G10D 3/02 84/267
9,646,581 B2 * 5/2017 Landis ..... G10D 3/00
2016/0163293 A1 * 6/2016 Landis ..... G10D 3/00 84/290
2017/0018266 A1 * 1/2017 Keeler ..... G10K 9/22

* cited by examiner

*Primary Examiner* — Robert W Horn
(74) *Attorney, Agent, or Firm* — Bagwell IP; Adam L. Bagwell

(57) ABSTRACT

The invention relates to a sound hole covering that prevents foreign items from entering into the body of an instrument, while minimizing the effects the covering may cause to the sound quality of the instrument. One such device for preventing a plectrum from entering into a body of an instrument may include, but is not limited to, a sound hole covering having a grid-like structure and a base clip, where one end of the base clip enters into the sound hole and pushes against a back surface of the soundboard while the covering is pressed against a top surface of the soundboard the other end of the base clip to enters into the sound hole in a similar fashion.

1 Claim, 9 Drawing Sheets

DEVICE FOR PREVENTING A PLECTRUM FROM ENTERING INTO INSTRUMENTS

BACKGROUND

Typically, a stringed instrument, such as an acoustic guitar, includes a generally hollow body. For most stringed instruments, the body is formed by a front or forward panel with a sound hole opening, one or more side boards connected to and extending back from the front panel, and a backboard attached along the back edges of the one or more side boards. This general configuration of elements creates a resonance chamber within the body of the guitar. One of ordinary skill in the pertinent arts may refer to the forward panel as a soundboard or topboard. While the sound hole opening generally has a circular shape, other shapes may be utilized to produce different tonal qualities of the guitar. Generally, these elements of an acoustic guitar are constructed of wood, composite materials, or other suitable materials, or some combination thereof.

A typical acoustic guitar also typically include a neck, wherein one end of the neck connects to the body and the other end terminates in a headstock. Guitar strings may then be strung from the headstock along the length of the neck towards the body and attached to a bridge connected the forward panel, with the bridge being positioned on the forward panel such that the strings extend over or near the sound hole. The bridge may optionally include a saddle, whereby vibrations from the strings are transferred to the forward panel, i.e., soundboard, resulting in the vibration of the entire soundboard. For example, the strings may vibrate when plucked, strummed, or otherwise displaced by a player's fingers or a plectrum, e.g., a "pick". When the strings vibrate above the sound hole, the overall bodily configuration of the guitar, including the resonance chamber, cooperate to amplify the sound created by the vibrating soundboard.

However, when playing a stringed instrument with a plectrum, there is a continuing risk that the plectrum or other foreign item may enter into the hollow body of the instrument via the sound hole. For example, the pick may fall out of the player's fingers when playing the instrument. The presence of the foreign item in the hollow body may alter the tonal qualities of the instrument, and retrieving the plectrum from the instrument is often time consuming and difficult. While current sound hole covers may prevent the introduction of the foreign item into the body of instrument, these covers mute the sound of the instrument and essentially defeat the purpose of the instrument's resonance chamber.

BRIEF SUMMARY OF THE INVENTION

The following presents a simplified summary in order to provide a basic understanding of some aspects of the invention. This summary is not an extensive overview. It is not ended to identify key or critical elements of the invention or to delineate the scope of the invention. The following summary merely presents some concepts of the invention in a simplified form as a prelude to the more detailed description provided below.

Aspects of the present invention relate to a sound hole covering that prevents foreign items from entering into the body of an instrument, while minimizing the effects the covering may cause to the sound quality of the instrument. According to aspects of the present invention, a device for preventing a plectrum from entering into a body of an instrument having a sound hole and a soundboard may include, but is not limited to, a sound hole covering having a grid-like structure and a base clip, where a first end of the base clip enters into the sound hole and pushes against a back surface of the soundboard while the covering is pressed against a top surface of the soundboard and said covering is positioned to allow a second end of the base clip to enter into the sound hole, wherein the second end is slid towards the soundboard until said first end and said second end are positioned against the back surface of said soundboard and said covering is pressed against the top surface of the soundboard.

DETAILED DESCRIPTION

In the following description of the various embodiments, reference is made to the accompanying drawings, which form a part hereof, and in which is shown by way of illustration various embodiments in which features may be practiced. It is to be understood that other embodiments may be utilized and structural and functional modifications may be made.

Figure 1A:
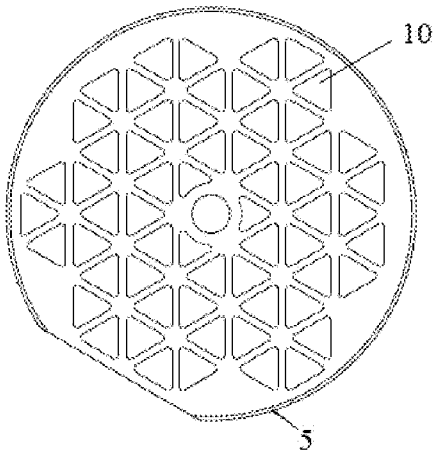
FIG. 1A illustrates an exemplary diagram of a top view of an exemplary sound hole covering.
Figure 1B:
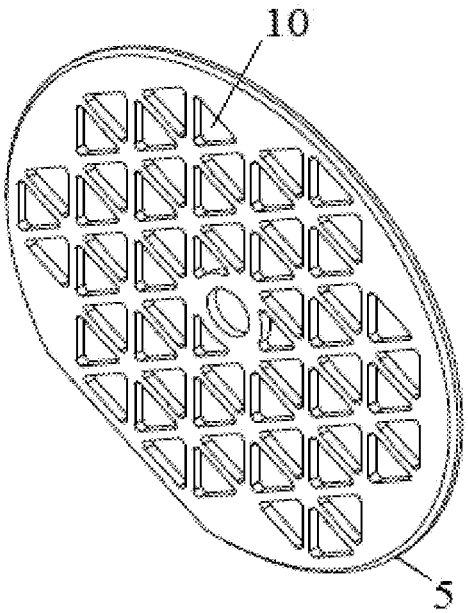
FIG. 1B illustrates a bottom view of an exemplary sound hole covering.
Figure 1C:
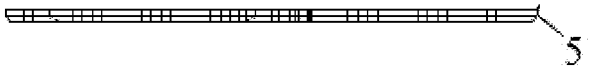
FIG. 1C illustrates any exemplary diagram side view of an exemplary sound hole covering, each according to various aspects described herein.
Figure 4:
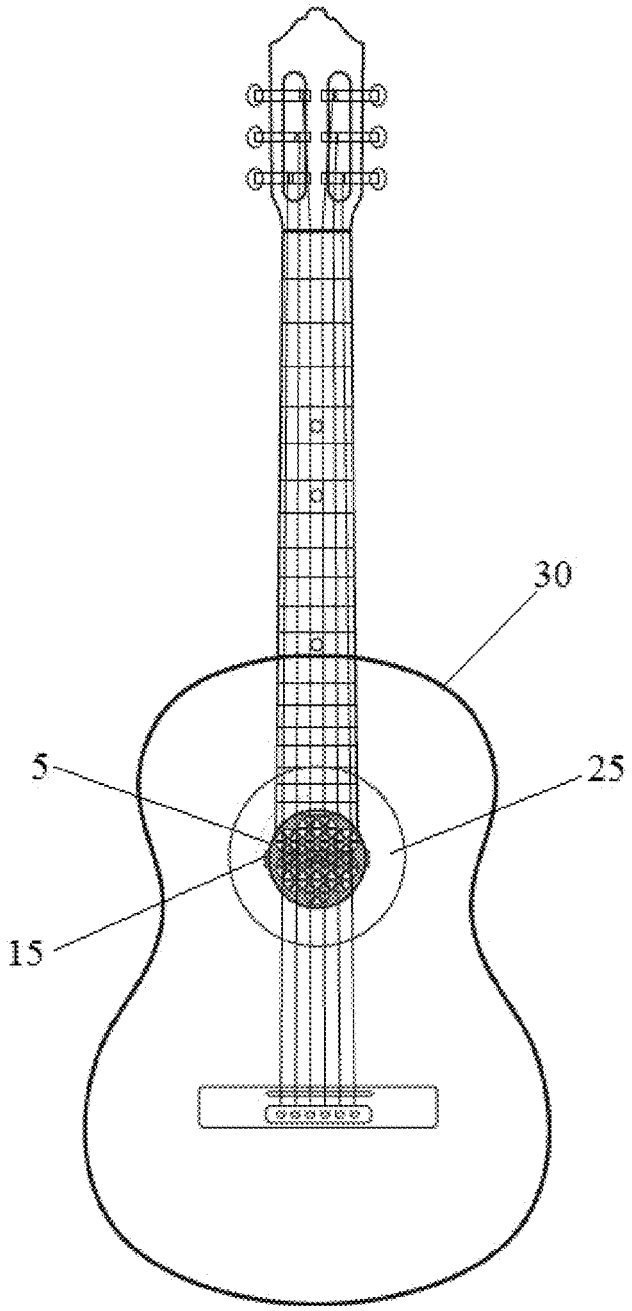
FIG. 4 illustrates an exemplary sound hole covering secured to an exemplary musical instrument using an exemplary base clip, according to various aspects described herein.

As noted above, current sound hole coverings significantly impact the sound quality of an acoustic instrument, as these coverings are made of a solid, continuous material that covers the sound hole. As illustrated in FIGS. 1A-1C, aspects of the present invention generally contemplate a covering 5 with a grid-like structure 10 that is large enough to cover the sound hole 25 of the instrument 30, an example of which is demonstrated in FIG. 4, where the covering 5 is held in place over the hole 25 by one or more clips (e.g., element 15 in FIG. 2). For example, FIGS. 1A-1C illustrate an exemplary sound hole covering 5 having a grid-like structure 10. Importantly, a grid structure allows the passage of air/sound through the openings in the grid 10, while the physical structure of the grid 10 prevents foreign items that are bigger than the openings, e.g., a guitar pick, from entering into the body of the instrument 30. While FIGS. 1A-1C illustrate one particular grid-like structure, other configuration or structures may be utilized without departing from the scope of the present invention. According to aspects of the present invention, a sound hole covering 5 may be constructed, formed, molded, or otherwise created from plastic, wood, a composite material, or other appropriate materials, or some combination thereof.

Figure 2A:
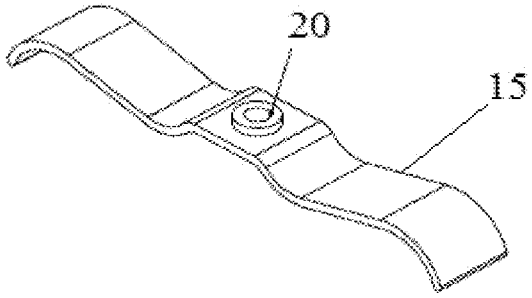
FIG. 2A illustrates an exemplary diagram of a top view of an exemplary sound hole covering.
Figure 2B:
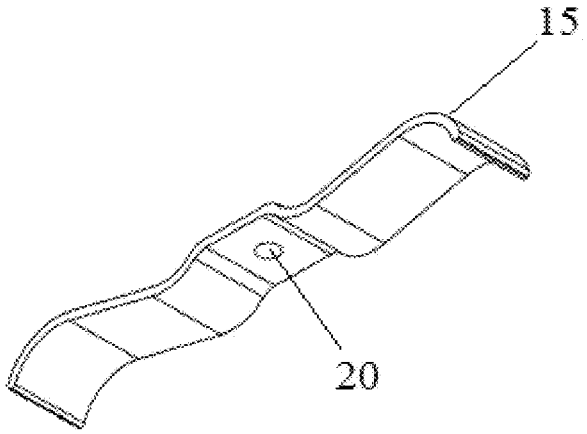
FIG. 2B illustrates a bottom view of an exemplary sound hole covering.
Figure 2C:
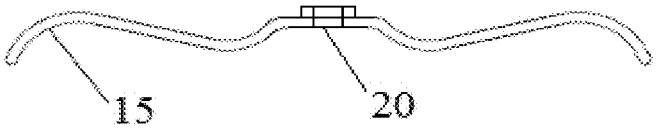
FIG. 2C illustrates any exemplary diagram side view of an exemplary sound hole covering, each according to various aspects described herein.

As noted above, FIG. 2 illustrates an exemplary base clip 15 for securing the sound hole covering 5 to an instrument 25. In the example shown in FIG. 2, the base clip 15 acts as a dual friction clip that provides tension between a bottom surface of the covering 5 and the top surface of the soundboard of the instrument 30. While FIG. 2 and FIGS. 1A-1C show an exemplary base clip that is approximately ⅓ the width of the grid, other sizes of base clips may be utilized without departing from the scope of the present invention. As illustrated in FIG. 2, an exemplary base clip 15 may include a connector 20 for connecting to the covering 5, e.g., a rubber grommet that fits within an opening in the covering. In other embodiments, a bonding agent may be utilized to join the base clip 15 to the sound hole covering 5. While FIG. 2 illustrates an exemplary clip 15 with curved arms extending from a central connector 20, other configurations may be utilized that provide the appropriate tension (described above) without departing from the scope of the present invention. Furthermore, while FIGS. 1A-1C and FIG. 2 illustrate an exemplary sound hold covering 5 and an exemplary base clip 15 as separate elements for joining together, the covering and base clip may comprise a single structure, such as an injection-molded covering with integrated clip.

Figure 3A:
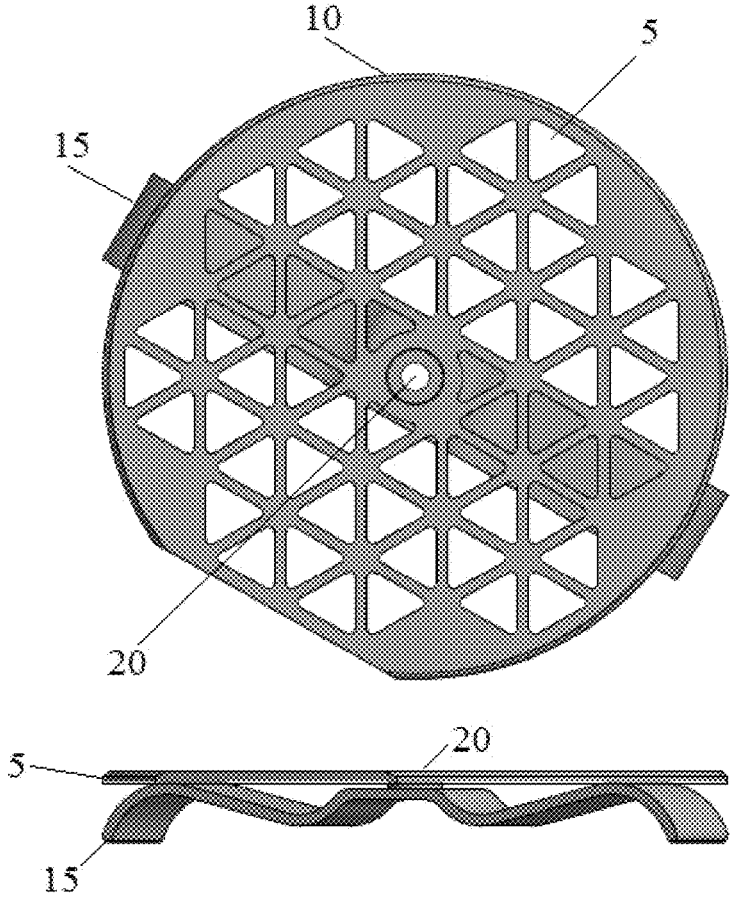
FIGS. 3A and 3B respectively illustrate a top view and a perspective view of an exemplary sound hole covering with a base clip attached thereto, according to various aspects described herein.
Figure 3B:
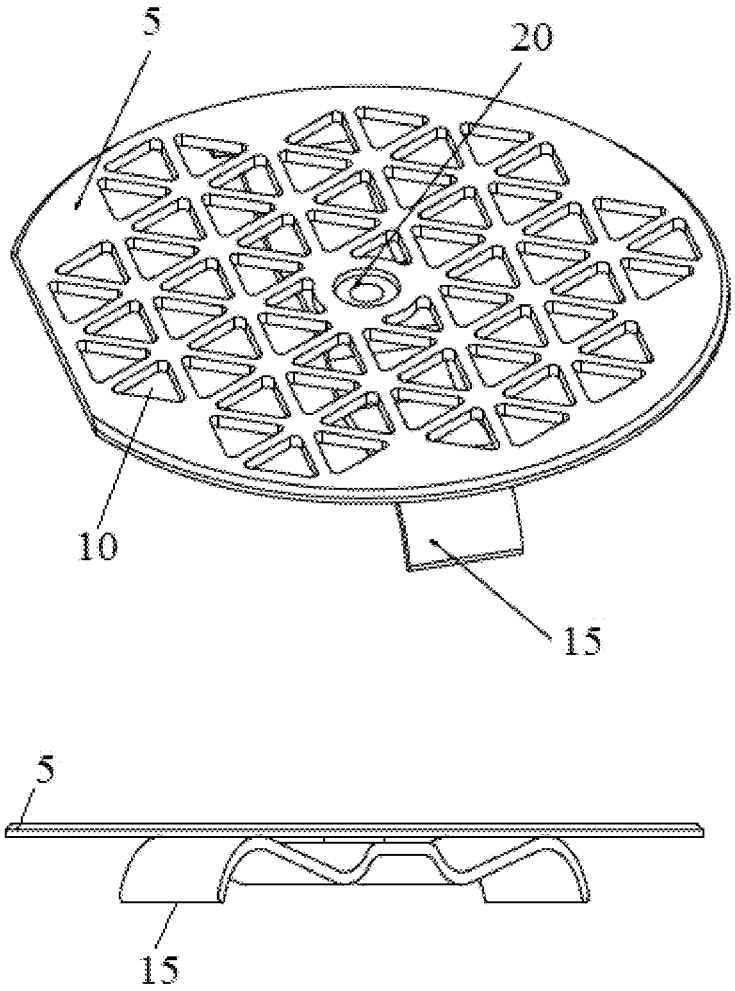

FIGS. 3A and 3B illustrate an exemplary grid-like covering 5 having an exemplary base clip 15 attached thereto. In order to secure the exemplary covering 5 to an instrument 30 (e.g., FIG. 4), the exemplary device may be inserted into the sound hole 25 of the instrument 30 in a manner appropriate to the instrument. For example, one end of the covering 5 may be slipped under the strings of the instrument 30 and over the sound hole 25, such that a first end of the base clip 15 enters into the sound hole 25 and pushes against the back surface of the soundboard while the grid-like covering 5 is pressed against the top surface of the soundboard. The covering 5 may then be positioned to allow a second end of the base clip 15 to enter into the sound hole 25. The second end may then be slid towards the soundboard until both ends are positioned against the bottom surface of the soundboard and the covering 5 is pressed against the top surface of the soundboard. This "final positioning" is demonstrated in FIG. 4, which illustrates an exemplary sound hole covering 5 secured to an exemplary musical instrument 30 (e.g., a guitar) using an exemplary base clip 15, according to various aspects described herein.

According to aspects of the present invention, the covering 5 should be larger than the sound hole 25 of the instrument 30 with which the covering 5 is to be used. As noted above, while the grid design may vary, the exemplary grid structure shown in the FIGURES illustrates openings that are generally larger than 0.3 inches, but smaller than 0.75 inches.

Advantageously, aspects of the present invention allow a player to drop a plectrum without the risk of it falling into the sound hole 25 of the instrument 30, such as a guitar or ukulele, while simultaneously allowing sound from the strings to resonate through the sound hole 25 and into the body of the instrument 30 with minimal impact on the sound quality of the instrument 30.

Although the subject matter has been described in language specific to structural features and/or methodological acts, it is to be understood that the subject matter described throughout is not necessarily limited to the specific features or acts described above. Rather, the specific features and acts described above are disclosed as example forms of implementing the claims.

What is claimed is:

1. A device for preventing a plectrum from entering into a body of an instrument having a sound hole and a soundboard, said device comprising:

a sound hole covering, said covering having an upper surface and a bottom surface, said covering having a grid-like structure; and a base clip, said base clip positioned on said bottom surface, wherein a first end of the base clip enters into the sound hole and pushes against a back surface of the soundboard while said bottom surface of said covering is pressed against a top surface of the soundboard and said covering is positioned to allow a second end of the base clip to enter into the sound hole, wherein the second end is slid towards the soundboard until said first end and said second end are positioned against the back surface of said soundboard and said bottom surface of said covering is pressed against the top surface of the soundboard, wherein said covering minimally affects sound resonance within the body of the instrument.

* * * * *